US006401362B1

(12) United States Patent
Schultz et al.

(10) Patent No.: US 6,401,362 B1
(45) Date of Patent: Jun. 11, 2002

(54) CLOTHES DRYING APPARATUS AND METHOD WITH IMPROVED TUMBLING ACTION

(75) Inventors: Stephen D. Schultz; John F. Gerling, both of Modesto, CA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/588,272

(22) Filed: Jun. 5, 2000

(51) Int. Cl.[7] ..... F26B 3/00
(52) U.S. Cl. ..... 34/499; 34/599; 34/602
(58) Field of Search ..... 34/599, 602, 425, 34/499, 322, 328

(56) References Cited

U.S. PATENT DOCUMENTS 2,867,107 A * 1/1959 Brown ..... 34/599
3,555,701 A * 1/1971 Hubbard ..... 34/602
3,605,281 A * 9/1971 Hubbard et al. ..... 34/599
3,729,834 A * 5/1973 Fox ..... 34/599
3,840,998 A * 10/1974 Marcussen ..... 34/599
3,938,357 A * 2/1976 Lieb ..... 34/599
4,702,016 A * 10/1987 Grigsby et al. ..... 34/499
4,881,325 A * 11/1989 Jordan et al. ..... 34/599
5,371,956 A * 12/1994 St. Louis ..... 34/599
5,416,983 A * 5/1995 Moser ..... 34/602
5,421,103 A * 6/1995 Wunderlich ..... 34/599
6,067,729 A * 5/2000 Willis ..... 34/499
6,116,060 A * 9/2000 Strader ..... 34/599

* cited by examiner

*Primary Examiner*—Teresa Walberg
*Assistant Examiner*—Fadi H. Dahbour
(74) *Attorney, Agent, or Firm*—Flehr Hohbach Test Albritton & Herbert LLP

(57) ABSTRACT

Tumble drying apparatus and method in which fabric articles are placed in a horizontally disposed cylindrical basket with a stringer which extends across the basket along an arcuate path that passes near the axis, and the basket is rotated about its axis with the stringer causing the fabric articles to tumble through the central portion of the basket in a loosely packed manner as they fall from one side of the basket toward the other.

11 Claims, 1 Drawing Sheet

CLOTHES DRYING APPARATUS AND METHOD WITH IMPROVED TUMBLING ACTION

This invention pertains generally to the drying of clothes and, more particularly, to a tumble dryer and method with improved tumbling action.

A common method of drying fabric articles such as clothing is to use what is commonly known as a tumble dryer. Such dryers typically have a cylindrical drum or basket with radial vanes which cause the fabric articles to tumble or fall from one side of the basket to another as it rotates about a horizontal axis. The relationships between diameter of the basket, the speed of rotation, and the configuration of the vanes is important in obtaining the optimal tumble pattern for efficient drying. The most efficient tumble pattern is one in which the fabric articles are maintained in a loosely packed arrangement that allows the moisture contained within the fabric to escape freely.

A typical method of monitoring the moisture content in the fabric is with a sensor located at one end of the basket. The moisture content is measured as the fabric articles fall onto the sensor, and the reliability of the moisture measurements is greatly affected by the manner in which the articles tumble. A more loosely packed arrangement of fabric articles results in more regular contact with the sensor and, hence, more reliable measurements.

As the diameter of the rotating basket becomes smaller relative to the size of the fabric articles, it becomes more difficult to achieve an optimal tumble pattern. The articles tend to become bunched and tightly packed, inhibiting the free escape of moisture contained in the fabric. The vanes on the internal surface of the basket are of only limited utility because the fabric tends to roll off the vanes, rather than falling off, causing the fabric to roll up in a tight bundle. This bundling not only prevents moisture from escaping from the fabric, but also results in less regular contact with the moisture sensor and less reliable moisture measurements.

It is in general an object of the invention to provide a new and improved clothes drying apparatus and method with improved tumbling action.

Another object of the invention is to provide an apparatus and method of the above character which overcome the limitations and disadvantages of tumble dryers heretofore provided.

These and other objects are achieved in accordance with the invention by providing a tumble drying apparatus and method in which fabric articles are placed in a horizontally disposed cylindrical basket with a stringer which extends across the basket along an arcuate path that passes near the axis, and the basket is rotated about its axis with the stringer causing the fabric articles to tumble through the central portion of the basket in a loosely packed manner as they fall from one side of the basket toward the other.

Figure 1:
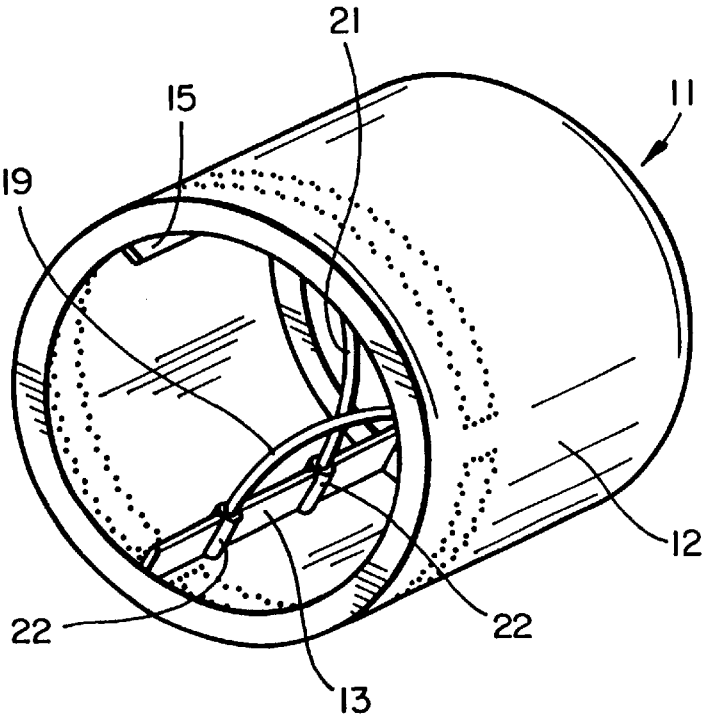
FIG. 1 is an isometric view of one embodiment of clothes drying apparatus incorporating the invention.
Figure 2:
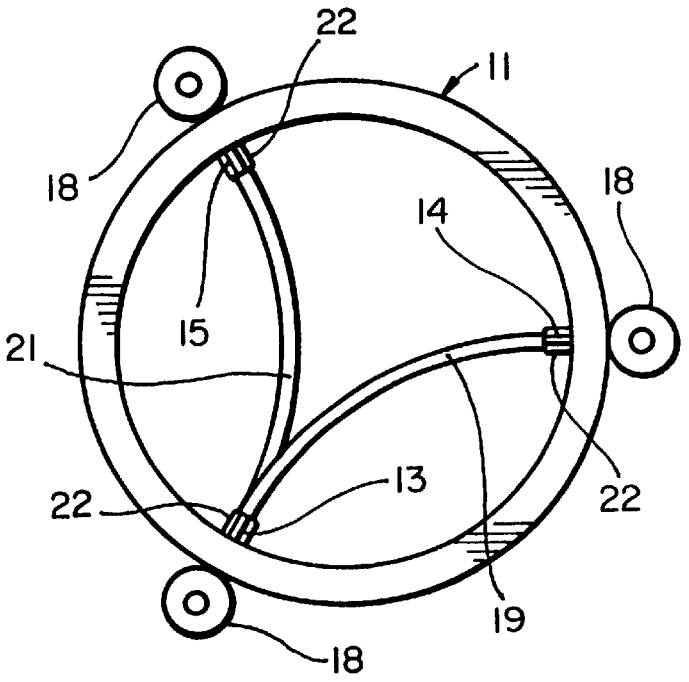
FIG. 2 is a front elevational view of the embodiment of FIG. 1, with the addition of rollers for rotating the basket about a its axis.

As illustrated in FIG. 1, the drying apparatus includes a drum or basket 11 which has a cylindrical side wall 12, with a plurality of longitudinally extending vanes 13–15 projecting inwardly therefrom. In the embodiment illustrated, three vanes are spaced equally about the periphery of the basket, but a different number of vanes and/or a different spacing can be employed, if desired. The basket is disposed horizontally, with rollers 18 for rotating it about its axis.

Stringers 19, 21 are mounted in the basket to improve the tumbling action of the clothes or other fabric articles within the rotating basket. These stringers consist of relatively rigid rods or tubes which extend along arcuately curved paths across the basket, passing generally through the center of the basket near the axis.

The two stringers lie in radial planes which are spaced axially apart by a distance sufficient to prevent fabric articles from becoming trapped between them. In the embodiment illustrated, the two stringers are spaced equally from the ends of the basket, with the distance between them being slightly greater than the distance between the stringers and the ends of the basket.

The end portions of the stringers are mounted in sockets 22 which are integral with the vanes, with stringer 19 extending between vanes 13 and 14, and stringer 21 extending between vanes 13 and 15. The stringers are removably mounted in the sockets so that they can be removed for larger loads or for cleaning.

The basket and the stringers can be made of any materials which are suitable for use in the dryer in which they are employed. In conventional fabric dryers, the materials can be either metallic or non-metallic, In microwave fabric dryers, the materials are preferably non-metallic to prevent arcing in the presence of metal objects in or on the clothes, and they preferably have a relatively low dielectric loss to prevent absorption of the microwave energy.

Operation and use of the drying apparatus, and therein the method of the invention, is as follows. The clothes or other fabric articles to be dried are placed in the basket, and the dryer is run through a normal operating cycle. As the basket rotates, the stringers break up the fall of the fabric articles as they tumble through the center of the basket, causing a more irregular tumble pattern and loosening of the bundle. That allows moisture contained within the fabric to vaporize and escape more freely. It also causes the fabric articles to make more regular contact with the moisture sensor, thereby increasing the reliability of the sensor for controlling the drying process.

The use of the stringers in horizontal tumble dryers with smaller baskets has been found to have unique advantages that are not apparent in dryers with larger baskets. With larger baskets, the articles fall through greater distances as they tumble, and the vanes typically employed in such baskets may provide acceptable tumble patterns. With smaller baskets, however, that is not the case, and the stringers provide a significant improvement in tumble pattern.

The invention is applicable to any tumble dryer which has a horizontally disposed basket that rotates about a horizontal axis. It is particularly suitable for use in residential laundry as well as in commercial markets such as hospitals, hotels, spas and health clubs.

It is apparent from the foregoing that a new and improved tumble drying apparatus and method have been provided. While only certain presently preferred embodiments have been described in detail, as will be apparent to those familiar with the art, certain changes and modifications can be made without departing from the scope of the invention as defined by the following claims.

What is claimed is:

1. In apparatus for drying fabric articles: a basket having a cylindrical side wall and a horizontally extending axis about which the basket rotates, a plurality of longitudinally extending vanes which project inwardly from the side wall of the basket, and a pair of stringers each of which extends across the basket between two of the vanes along an arcuate path that bows inwardly and passes near the axis to promote a loosely packed tumbling of fabric articles through the center portion of the basket as the basket rotates.

2. The apparatus of claim 1 wherein the stringers are spaced apart along the axis of the basket.

3. The apparatus of claim 1 wherein one of the stringers extends between first and second ones of the vanes, and the other stringer extends between the first and third ones of the vanes.

4. The apparatus of claim 1 wherein the stringers are removably attached to the vanes.

5. The apparatus of claim 4 wherein end portions of the stringers are received in sockets on the vanes.

6. In a method of drying fabric articles, the steps of: placing the articles in a horizontally disposed cylindrical basketwith inwardly projecting longitudinally extending vanes and a pair of stringers each of which extends across the basket between two of the vanes along an arcuate path that bows inwardly and passes near the axis, and rotating the basket about its axis with the stringers causing the fabric articles to tumble through the central portion of the basket in a loosely packed manner as they fall from one side of the basket toward the other.

7. In apparatus for drying fabric articles: a basket having a cylindrical side wall and a horizontally extending axis about which the basket rotates, and a stringer extending across the basket along an arcuate path that bows inwardly from the side wall and passes near the axis to promote a loosely packed tumbling of fabric articles through the center portion of the basket as the basket rotates.

8. The apparatus of claim 7 including a second stringer which also extends across the basket along an arcuate path that bows inwardly and passes near the axis.

9. The apparatus of claim 8 wherein the stringers lie in axially spaced radial planes.

10. The apparatus of claim 7 wherein the stringer is removably mounted in the basket.

11. In a method of drying fabric articles, the steps of: placing the articles in a horizontally disposed cylindrical basket with a stringer which extends across the basket along an arcuate path that bows inwardly from the side wall and passes near the axis, and rotating the basket about its axis with the stringer causing the fabric articles to tumble through the central portion of the basket in a loosely packed manner as they fall from one side of the basket toward the other.

* * * * *